US007007469B2

(12) United States Patent
Bliesner

(10) Patent No.: US 7,007,469 B2
(45) Date of Patent: Mar. 7, 2006

(54) DUAL SHELL STIRLING ENGINE WITH GAS BACKUP

(76) Inventor: Wayne T. Bliesner, 15515 Juanita-Woodinville Way NE., I-203, Bothell, WA (US) 98011

( * ) Notice: Subject to any disclaimer, the term of this patent is extended or adjusted under 35 U.S.C. 154(b) by 0 days.

(21) Appl. No.: 10/483,784

(22) PCT Filed: Jul. 12, 2002

(86) PCT No.: PCT/US02/22009

§ 371 (c)(1),
(2), (4) Date: Jan. 13, 2004

(87) PCT Pub. No.: WO03/006812

PCT Pub. Date: Jan. 23, 2003

(65) Prior Publication Data

US 2004/0168438 A1 Sep. 2, 2004

Related U.S. Application Data

(60) Provisional application No. 60/304,924, filed on Jul. 13, 2001.

(51) Int. Cl.

| | |
|---|---|
| ***F01B 25/06*** | (2006.01) |
| ***F01B 29/10*** | (2006.01) |
| ***F02B 75/04*** | (2006.01) |
| ***F02B 77/00*** | (2006.01) |
| ***F02G 1/043*** | (2006.01) |

(52) U.S. Cl. ..... 60/517; 60/520; 60/526

(58) Field of Classification Search ..... 60/517, 60/520, 526

See application file for complete search history.

(56) References Cited

U.S. PATENT DOCUMENTS

| | | | | |
|---|---|---|---|---|
| 3,344,894 | A | | 10/1967 | Kenworthy |
| 3,949,554 | A | | 4/1976 | Noble et al. |
| 3,991,457 | A | | 11/1976 | Barton |
| 4,013,117 | A | | 3/1977 | Kopetzki et al. |
| 4,052,854 | A | * | 10/1977 | du Pre et al. ..... 60/524 |
| 4,055,951 | A | | 11/1977 | Davoud et al. |
| 4,093,435 | A | | 6/1978 | Marron et al. |

(Continued)

FOREIGN PATENT DOCUMENTS

DE 2519869 11/1976

(Continued)

OTHER PUBLICATIONS

Knowles, Timothy R.; Composite-Matrix Regenerators for Stirling Engines; NASA Tech Briefs LEW-16581 Jan. 1997, NASA USA.

(Continued)

*Primary Examiner*—Sheldon J Richter

(57) ABSTRACT

A Stirling engine which utilizes an inner and outer dual shell pressure containment system surrounding the high pressure and temperature engine components. The space between the shells is filled with a pressure backup gas and an insulation material with the backup gas being in communications with the working fluid. The backup gas and insulation provide a time varying pressure field, driven by the pressure variations in the Stirling engine working fluid, which cancels the pressure differential on the heat transfer tubing and allows an averaging of pressures during each cycle of engine operation. In one embodiment the backup gas is placed inside the inner shell.

48 Claims, 5 Drawing Sheets

U.S. PATENT DOCUMENTS

| | | | | |
|---|---|---|---|---|
| 4,174,616 | A | 11/1979 | Nederlof et al. | |
| 4,200,441 | A | 4/1980 | Honmann et al. | |
| 4,214,447 | A | 7/1980 | Barton | |
| 4,235,116 | A | 11/1980 | Meijer et al. | |
| 4,382,452 | A | 5/1983 | Loveless | |
| 4,405,010 | A | 9/1983 | Schwartz | |
| 4,425,764 | A | 1/1984 | Lam | |
| 4,429,732 | A | 2/1984 | Moscrip | |
| 4,607,424 | A | 8/1986 | Johnson | |
| 4,625,514 | A | 12/1986 | Tanaka et al. | |
| 4,638,633 | A | 1/1987 | Otters | |
| 4,662,176 | A | 5/1987 | Fujiwara et al. | |
| 4,722,188 | A | 2/1988 | Otters | |
| 4,723,410 | A | 2/1988 | Otters | |
| 4,742,679 | A | 5/1988 | Inoda et al. | |
| 4,774,808 | A | 10/1988 | Otters | |
| 4,799,421 | A | 1/1989 | Bremer et al. | |
| 4,815,290 | A | 3/1989 | Dunstan | |
| 4,832,118 | A | 5/1989 | Scanlon et al. | |
| 4,869,212 | A | 9/1989 | Sverdlin | |
| 4,887,793 | A | 12/1989 | Hernandez et al. | |
| 4,894,989 | A | 1/1990 | Mizuno et al. | |
| 5,074,114 | A | 12/1991 | Meijer et al. | |
| 5,140,905 | A | 8/1992 | Dhar | |
| 5,217,681 | A | 6/1993 | Wedellsborg et al. | |
| 5,242,015 | A | 9/1993 | Saperstein et al. | |
| 5,339,653 | A | 8/1994 | DeGregoria | |
| 5,355,679 | A | 10/1994 | Pierce | |
| 5,383,334 | A | 1/1995 | Kaminishizono et al. | |
| 5,388,410 | A | 2/1995 | Momose et al. | |
| 5,429,177 | A | 7/1995 | Yaron et al. | |
| 5,433,078 | A | 7/1995 | Shin | |
| 5,465,781 | A | 11/1995 | DeGregoria | |
| 5,555,729 | A | 9/1996 | Momose et al. | |
| 5,611,201 | A | 3/1997 | Houtman | |
| 5,715,683 | A | 2/1998 | Hofbauer et al. | |
| 6,041,598 | A | 3/2000 | Bliesner | |
| 6,230,607 | B1 | 5/2001 | Rehrl et al. | |
| 6,263,671 | B1 | 7/2001 | Bliesner | |
| 6,293,101 | B1 * | 9/2001 | Conrad | 60/526 |
| 6,311,491 | B1 * | 11/2001 | Conrad | 60/526 |
| 6,347,453 | B1 | 2/2002 | Mitchell | |
| 6,389,811 | B1 * | 5/2002 | Urasawa et al. | 60/517 |
| 6,526,750 | B1 | 3/2003 | Bliesner et al. | |
| 2001/0042373 | A1 * | 11/2001 | Bliesner et al. | 60/517 |
| 2004/0168438 | A1 * | 9/2004 | Bliesner | 60/517 |

FOREIGN PATENT DOCUMENTS

| | | |
|---|---|---|
| EP | 0220622 | 10/1986 |
| WO | WO 8200320 | 2/1982 |
| WO | WO 98/25008 | 11/1998 |

OTHER PUBLICATIONS

Walker, Graham.; Stirling Engines; 1980; pp 151-153; Clarendon Press Oxford; Oxford University Press, New York, US.

* cited by examiner

DUAL SHELL STIRLING ENGINE WITH GAS BACKUP

BACKGROUND OF INVENTION

1. Field of the Invention

The present invention relates, generally, to pressure chambers. More particularly, the invention relates to Stirling engines with a dual shell pressure chamber.

2. Background Information

The maximum Stirling engine efficiency is related to the Carnot efficiency which is governed by the ratio of maximum working fluid temperature relative to the minimum fluid temperature. Improvements in technologies which increase the margin between the two temperature extremes is beneficial in terms of total cycle efficiency. The lower working fluid temperature is typically governed by the surrounding air or water temperature; which is used as a cooling source. The main area of improvements result from an increase in the maximum working temperature. The maximum temperature is governed by the materials which are used for typical Stirling engines. The materials, typically high strength Stainless Steel alloys, are exposed to both high temperature and high pressure. The high pressure is due to the Stirling engines requirement of obtaining useful power output for a given engine size. Stirling engines can operate between 50 to 200 atmospheres internal pressure for high performance engines.

Since Stirling engines are closed cycle engines, heat must travel through the container materials to get into the working fluid. These materials typically are made as thin as possible to maximize the heat transfer rates. The combination of high pressures and temperatures has limited Stirling engine maximum temperatures to around 800° C. Ceramic materials have been investigated as a technique to allow higher temperatures, however their brittleness and high cost have made them difficult to implement.

U.S. Pat. No. 5,611,201, to Houtman, shows an advanced Stirling engine based on Stainless Steel technology. This engine has the high temperature components exposed to the large pressure differential which limits the maximum temperature to the 800° C. range. U.S. Pat. No. 5,388,410, to Momose et al., shows a series of tubes, labeled part number 22 a through d, exposed to the high temperatures and pressures. The maximum temperature is limited by the combined effects of the temperature and pressure on the heating tubes. U.S. Pat. No. 5,383,334 to Kaminiishizono et al, again shows heater tubes, labeled part number 18, which are exposed to the large temperature and pressure differentials. U.S. Pat. No. 5,433,078, to Shin, also shows the heater tubes, labeled part number 1, exposed to the large temperature and pressure differentials. U.S. Pat. No. 5,555,729, to Momose et al., uses a flattened tube geometry for the heater tubes, labeled part number 15, but is still exposed to the large temperature and pressure differential. The flat sides of the tube add additional stresses to the tubing walls. U.S. Pat. No. 5,074,114, to Meijer et al., also shows the heater pipes exposed to high temperatures and pressures.

The Stirling engine disclosed in the inventor's U.S. Pat. No. 6,041,598 overcomes the limitations and shortcomings of the above prior art by providing a dual shell pressure chamber. An inner shell surrounds the heat transfer tubing and the regenerator. The portion surrounding the heat transfer tubing contains a thermally conductive liquid metal to facilitate heat transfer from a heat source to the heat transfer tubing and also to transmit external pressure to the heat transfer tubing. An outer shell that acts as a pressure vessel surrounds the inner shell and contains a thermally insulating liquid between the inner and outer shells. Pressure of the working fluid as it flows through the regenerator is transmitted through the inner shell to the insulating liquid and back across the inner shell to the liquid metal surrounding the heat transfer tubing. This system tends to balance the pressure across the heat transfer tubing and the inner shell, thereby allowing the engine to operate with the working fluid at a high pressure to generate significant power while keeping the wall of the heat transfer tubing thin to facilitate heat transfer.

The preferred material for the insulating liquid is a salt or glass such as Boron Anhydride or a mixture of Boron Anhydride and Bismuth Oxide. Those materials are fairly viscous when liquid, but still allow significant convection currents. A filler material such as ceramic fiber or similar material is placed in the liquid salt region to minimize convective currents. While this can work very well to transmit and balance the pressure across the inner shell and across the heat transfer tubing, combining the filler material and the liquid salt and installing it between the shells in a manner that does not produce voids can be difficult. Also, before the salt melts it does not transmit pressure. Therefore, significant preheating must be done to thoroughly melt the salt before the engine can be run with significant pressure in the working fluid.

The present invention improves on the dual shell pressure chamber and overcomes the difficulties in using the insulating liquid between the shells by using gas instead of a liquid.

DETAILED DESCRIPTION

Figure 1:
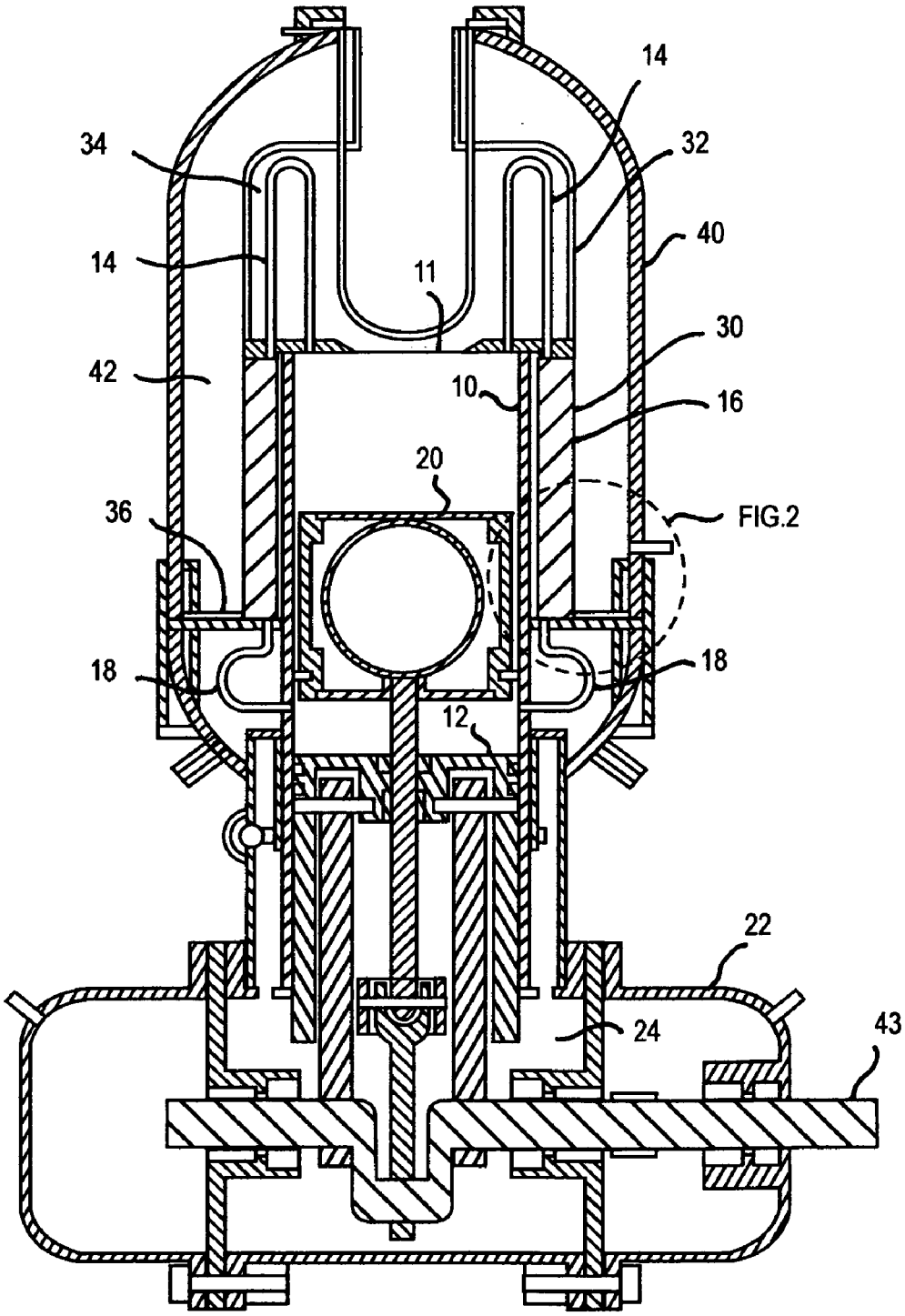
FIG. 1 is a longitudinal vertical cross sectional view showing the overall arrangement for a complete Stirling engine system.

U.S. Pat. No. 6,041,598 granted Mar. 28, 2000, and hereby incorporated by reference, discloses a dual shell pressure chamber as used with a Stirling engine. Referring to FIG. 1, a cylinder 10 is provided with an expansive bellows 11, a working fluid, such as Helium, is contained in cylinder 10 above power piston 12 and is shuttled through heat transfer tubing 14, regenerator 16, and cooling pipes 18 by the action of displacer piston 20. Lower housing 22 has an inner area 24 which acts as a reservoir for the working fluid and is in fluid communication with the working fluid in cylinder 10 through throttle ports in cylinder 10.

Figure 2:
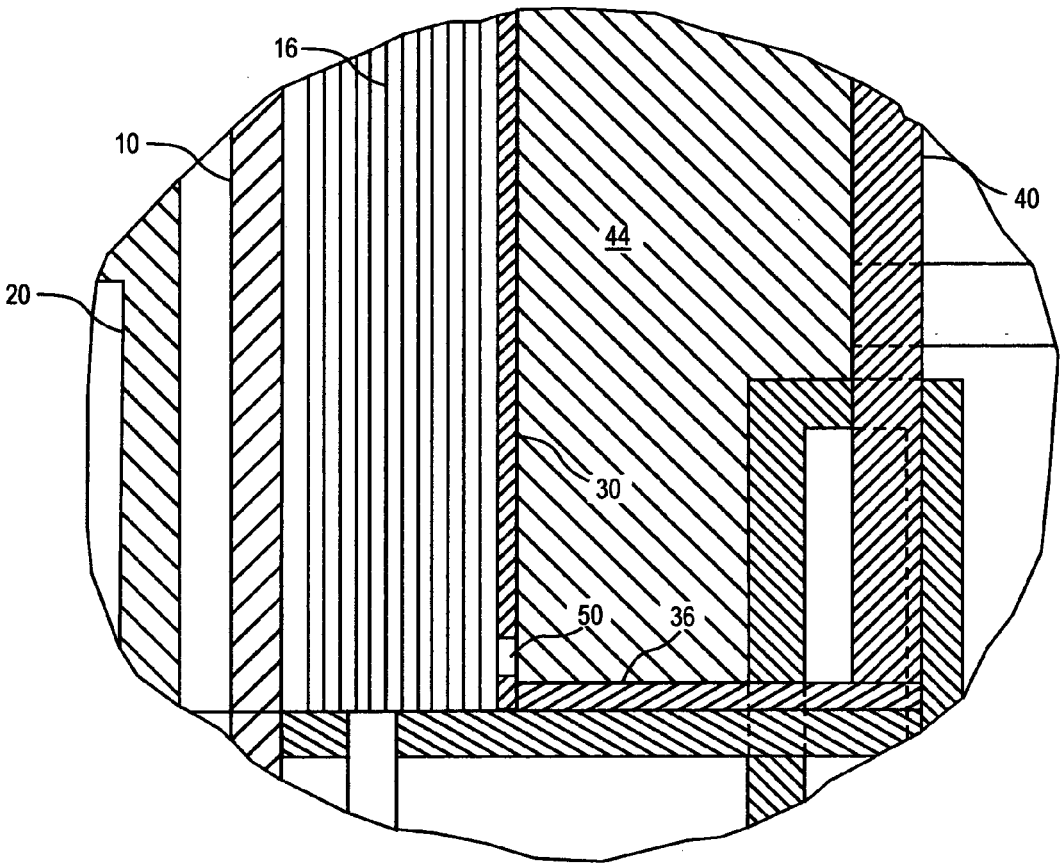
FIG. 2 is a detailed view of the circled portion of FIG. 1 illustrating an aperture in the inner shell and an insulating gas backup medium between the shells.

The inner shell 30 surrounds the heat transfer tubing 14 and regenerator 16. The upper portion 32 of inner shell 30 contains a liquid metal region 34 filled with a thermally conductive liquid metal, such as silver, which surrounds the heat transfer tubing 14. The regenerator 16 is preferably a coiled annulus of thin material disposed between cylinder 10 and inner shell 30. Outer shell 40 surrounds inner shell 30 and acts as a pressure vessel. The inner shell 30, outer shell 40 and flange 36 bound a pressure backup region 42. The pressure backup region is filled with a material to provide pressure backup against inner shell 30 and consequently through liquid metal region 34 to heat transfer tubing 14. It is also desirable that the pressure backup region 42 contain an insulating material 44, as depicted in FIG. 2, to minimize the heat transfer between the hot elements (heat transfer tubing 14, upper portion 32 of the inner shell, and the upper portion of regenerator 16) and cold elements (lower portion of regenerator 16, and flange 36) and to minimize the overall heat loss through the outer shell 40.

As an alternative to using an insulating liquid in the pressure backup region 42, as disclosed in U.S. Pat. No. 6,041,598, the present invention uses a gas, preferably the same gas as the working fluid, such as helium, in the pressure backup region 42, preferably in conjunction with the insulating material 44 such as carbon fiber mat or cloth, or ceramic fiber mat or cloth. In the alternative a lower conductivity gas such as Argon could be used as long as the gas in the backup region is not allowed to mix with the working fluid in cylinder 10. The insulating material 44 prevents significant convection current flow in the gas, thereby significantly reducing heat transfer through pressure backup region 42 as would occur with the use of gas alone. Since the gas is compressible, it does not transmit pressure like a liquid, so it will not transfer the transient pressure from the working fluid in the regenerator 16 to the liquid metal region 34, and consequently to the heat transfer tubing 14, like the liquid will when the engine is running. However, the gas does provide a fairly uniform backup pressure against the outside of the inner shell 30 which is transmitted to the liquid metal region 34 and consequently to the heat transfer tubing 14.

During engine operation with a heat source of approximately 2000 degrees F., pressure fluctuates inside cylinder 10 over a range of approximately 1000 psi during each cycle of the power piston 12. By pressurizing pressure backup region 42 to a desired amount, inner shell 30 and heat transfer tubing 14 can see only tensile, only compressive, or a combination tensile and compressive load. For example if the nominal pressure of the working fluid inside cylinder 10 is 1000 psi, during operation the pressure will range between 500 and 1500 psi. If the pressure in backup region 42 is set at 1500 psi, shell 30 and heat transfer tubing 14 see only a 0–1000 psi compressive load. This may be desirable to prevent any tensile cracking from occurring in those structures. In that case shell 30 may be compressed against regenerator 16 which may detrimentally effect the regenerator. Alternatively, the backup pressure may be set at 500 psi such that shell 30 and heat transfer tubing see only a 0–1000 psi tensile load, thus preventing any compression of shell 30 against the regenerator, but requiring shell 30 and heat transfer tubing 14 to have sufficient tensile strength. Setting the backup pressure at 1000 psi results in a ±500 psi tensile and compressive load across shell 30 and heat transfer tubing 14. The inventor believes this is the best mode of operation because it subjects the structures to the lowest absolute load.

Using the gas pressure backup in this manner, the pressure of the working fluid can be raised to any desirable level to produce significant power in the engine while the loads on the heat transfer tubing 14 and the inner shell 30 are kept low. The upper bounds of the pressure is limited only by safety and manufacturing considerations for the outer shell 40 and the lower housing 22, which function as a pressure vessel against the atmosphere. Lower housing 22 can be designed to enclose an electrical generator connected to the output shaft 43 of the dual shell Stirling engine, thereby eliminating the need for any external high-pressure seal against a rotating shaft extending through the lower housing.

Referring also to FIG. 2, when it is desired to operate the engine such that the backup pressure region 42 provides an average tensile and compressive load across inner shell 30, a small aperture 50 is provided through inner shell 30, preferably near flange 36. The advantage of placing the aperture in a low position is that it is in the cold section of the engine and thus the metal is stronger. Aperture 50 thereby allows fluid communication between backup pressure region 42 and the working fluid contained in cylinder 10 and the working fluid reservoir in inner area 24 of lower housing 22. When the engine is not running, all the pressures in these regions equalize. The working fluid for the engine may be charged to a desired nominal pressure, 1000 psi for example, using a single port, such as through the lower housing 22 into its inner area 24. Pressure in cylinder 10 and in backup pressure region 42 will also equalize at that pressure. When the engine starts to run, the pressure inside cylinder 10 will fluctuate plus or minus approximately 500 psi. Because the aperture 50 is very small, preferably approximately 0.02 to 0.06 and the engine is running typically over 1000 rpm, the movement of the gas through aperture 50 will be oscillatory and rather minimal. Thus the backup pressure in backup pressure region 42 is maintained at approximately a nominal level. The use of the small aperture 50 is preferred since it allows an averaging of pressures during each cycle. The advantage is that it tracks the average pressure ratio which may change during operation.

Figure 3:
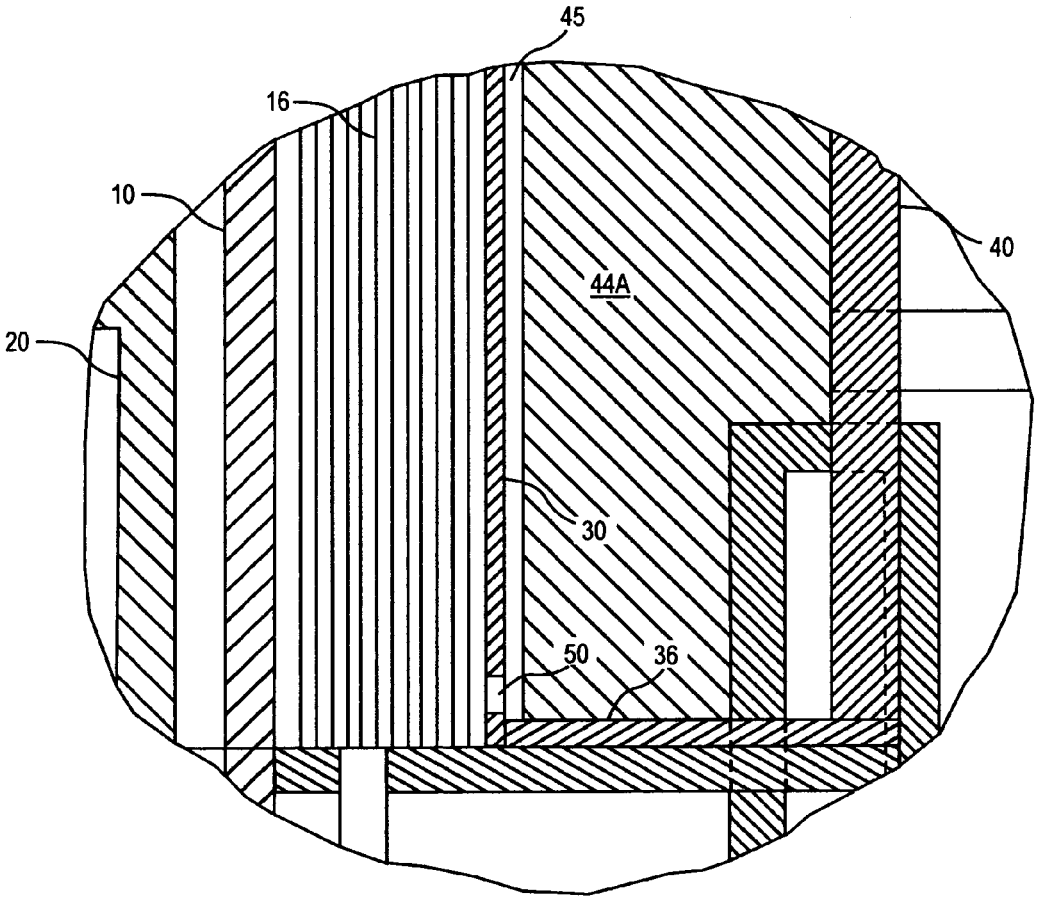
FIG. 3 is a detail view similar to FIG. 2 showing an annular gas backup chamber.

As pointed out above, the gas backup provides a fairly uniform backup pressure which is of advantage if the pressure in the region 42 were to track pressure in the regenerator region 16. As also mentioned, the aperture 50 allows an averaging of pressures during each cycle of the engine. As the size of the hole 50 increases, the pressures start to match. This is a favorable condition for stresses in the material but is detrimental to engine power which drops as more and more flow goes in and out of the port 50 with each stroke. FIG. 3 illustrates one method of reducing the required gas flow through the port 50 which involves the use of a material in the region 44*a* which may be either a solid or only a slightly porous material. This material acts as an insulation and may comprise a cast ceramic material which is both rigid and fairly low in thermal conductivity. Filling the region 42 which such a ceramic material reduces the volume of gas required, which is restricted to the annular space 45 maintained between the ceramic insulation and the wall of the inner shell 30. This smaller volume would be much easier to pressurize in a time varying manner. As illustrated, the annular space 45 is connected to the working fluid, i.e. the helium gas in regenerator 16 as previously described.

Figure 4:
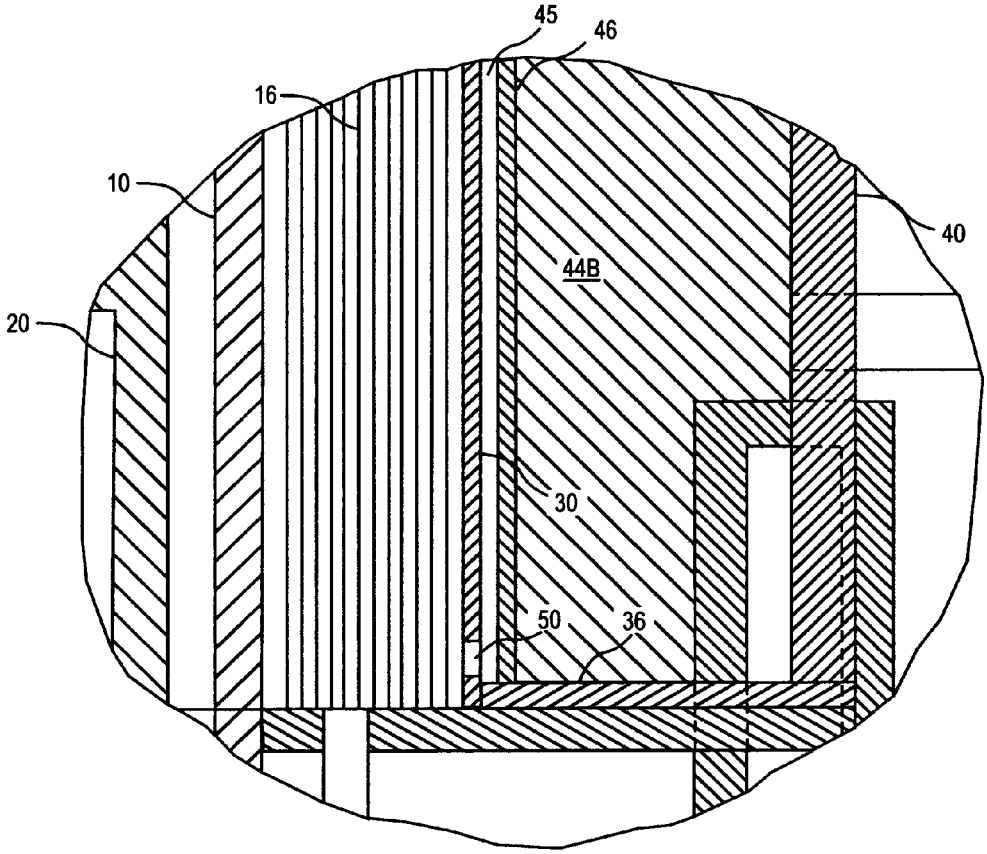
FIG. 4 is a detailed view similar to FIG. 2 showing an annular gas backup chamber and an insulation protection wall.

FIG. 4 illustrates still another embodiment similar to the FIG. 3 embodiment wherein the ceramic insulation material 44*b* is spaced from the wall of the inner shell 30 with a thin stainless steel wall 46 being located on the inner border of the material 44*b*. The wall 46 is spaced a slight distance from the inner shell 30, defining a narrow annulus 45 for gas containment as previously described. In this instance, the ceramic insulator may be slightly porous for the purpose of improving its heat transfer properties. The ceramic insulator would be constructed strong enough to hold the pressure field being applied on the inside of the thin wall. This structure provides the narrow annulus which is pressurized with the gas thereby allowing a reduced volume requirement for a time varying pressure match. Aperture 50 in this instance could be larger to more closely match the pressure i.e. approximately 0.2 to 0.5 inches in diameter. Several holes 50 could be placed around the wall to provide a more balanced time varying pressure.

Figure 5:
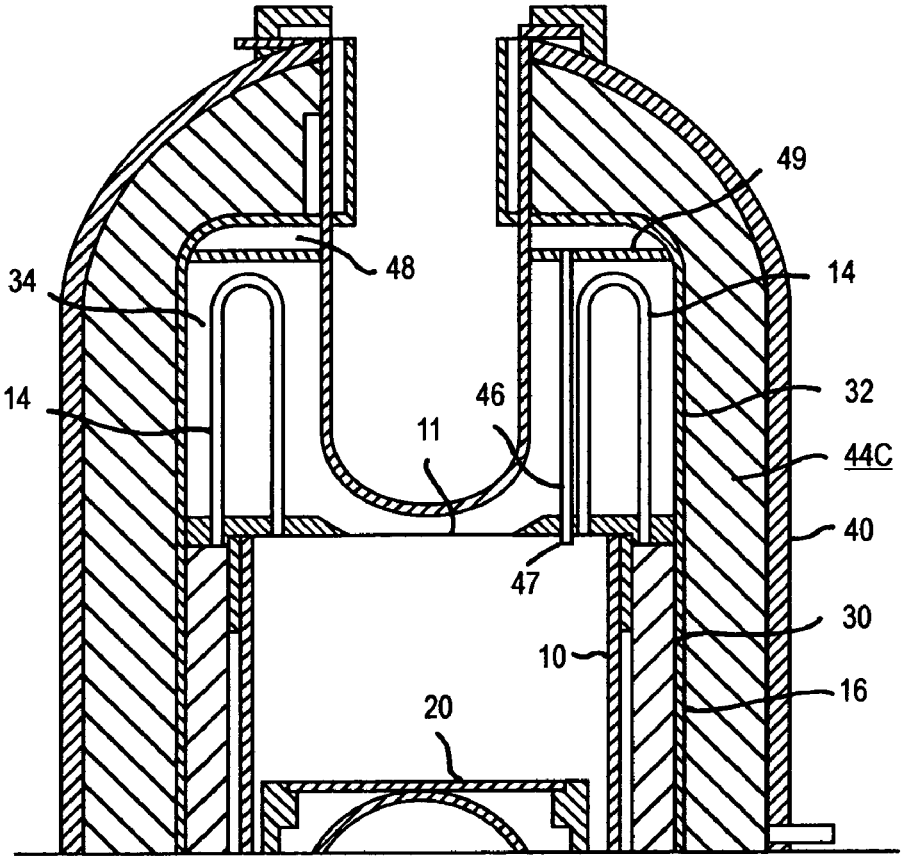
FIG. 5 is a partial longitudinal vertical cross sectional view of the upper portion of the Stirling engine showing the placement of a gas backup chamber within the inner shell above the heat transfer tubing.

FIG. 5 illustrates still another embodiment wherein the gas backup medium may be placed above the liquid metal region 34. The region 42 would be provided with a ceramic insulation material 44*c* as previously described, completely filling the region between the inner and outer shells. In the alternative, in this embodiment, the region 42 could be filled with an insulating liquid salt or glass as disclosed in applicant's previous patent. As shown in FIG. 5, a feeder pipe 47 extends from the upper portion of the cylinder 10 containing the working fluid, traverses through the liquid metal region 34 and communicates with the backup gas region 48 above the liquid metal region. As described for previous embodiments, the backup gas area 48 thus is connected to the working fluid and allows an averaging of pressures during each cycle. Although backup gas region 48 may be directly interfaced with the liquid metal region 34, it may be desirable to place solid ceramic or metal layer such as the layer 49 between the liquid metal and the backup gas to keep the liquid metal from splashing into the inside of the engine. The backup gas arrangement in this embodiment performs substantially in the same manner as previously described in the various embodiments in allowing an averaging of pressures during each cycle or a time varying pressure dependent on the size of pipe 47.

Because the backup pressure region 42 or region 48, the working fluid area inside cylinder 10, and the working fluid reservoir in inner area 24 of lower housing are all in fluid communication, the overall average pressure in all these areas may be adjusted upward or downward, such as through a single port in the lower housing, while the engine is running.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention.

What is claimed is:

1. An insulating high temperature dual shell pressure chamber comprising;

an inner container adapted to contain a working fluid which is operating in a time varying high temperature and pressure field, an outer pressure container surrounding said inner container defining a space therebetween, heat insulating material contained in the space between said inner and outer container for holding said pressure field and minimizing heat transfer between hot and cold regions of said pressure chamber, and a pressure backup region containing a pressurized gas medium constructed and arranged to transmit a uniform backup gas pressure to said working fluid.

2. The dual shell pressure chamber of claim 1 including;

means to selectively vary the gas pressure in said pressure backup region, and connector means for maintaining said gas medium and said working fluid in fluid communication during operating cycles. and said working fluid in fluid communication during operating cycles.

3. The dual shell pressure chamber of claim 1 wherein said pressure backup region is located within said inner container for transmitting a uniform backup pressure to said working fluid.

4. The dual shell pressure chamber of claim 3 including;

means to selectively vary the gas pressure in said pressure backup region, and connector means for maintaining said gas medium and said working fluid in fluid communication during operating cycles.

5. The dual shell pressure chamber of claim 3 including;

a liquid metal heat transfer medium within said inner container and located between said working fluid and said pressure backup region, said connector means comprising a conduit extending from said working fluid, through said liquid metal and into said pressure backup region.

6. The dual shell pressure chamber of claim 5 including;

a thin metal wall separating said liquid metal from said pressure backup region.

7. The dual shell pressure chamber of claim 1 wherein said pressure backup region is located in the space between said inner and outer containers, said pressurized gas medium maintaining a uniform backup pressure transmitted to the working fluid through the wall of said inner container.

8. The dual shell pressure chamber of claim 7 including;

restrictive port means in the wall of said inner container for maintaining said gas medium and said working fluid in fluid communication during operating cycles, said restrictive port means being located in the cold section of the engine.

9. The dual shell pressure chamber of claim 8 including a plurality of restrictive port means in the wall of said inner container.

10. The dual shell pressure chamber of claim 7 including;

means to selectively vary the gas pressure in said pressure backup region, and restrictive port means in the wall of said inner container for maintaining said gas medium.

11. The dual shell pressure chamber of claim 10 wherein;

said insulating material is located within said gas medium, said gas medium and said insulating material occupying the entire space between the inner and outer containers.

12. The dual shell pressure chamber of claim 11 wherein;

said insulating material comprises a carbon fiber mat, said mat preventing significant convection current flow in the gas medium to reduce heat transfer through the pressure backup region.

13. The dual shell pressure chamber of claim 10 wherein;

said insulating material comprises a substantially solid material extending from the outer container and terminating a distance from the inner container wall to form an annular space defining said pressure backup region.

14. The dual shell pressure chamber of claim 13 wherein;

said insulating material comprises a solid rigid cast ceramic material.

15. The dual shell pressure chamber of claim 13 wherein;

said insulating material comprises a porous rigid cast ceramic material.

16. The dual shell pressure chamber of claim 15 including;

a thin metal wall on the inner surface of said insulating material spaced from said inner container, said metal wall and the inner container wall forming a narrow annulus defining said pressure backup region.

17. In a thermal engine having a hollow heat exchange element subjected to a time varying high temperature and pressure field source, a dual shell pressure containment system comprising;

an inner pressure container adapted to receive heat from an external heat source and filled with a substantially incompressible liquid heat transfer medium surrounding said heat exchange element, said heat exchange element adapted to contain a working fluid which is operating in a time varying high temperature and pressure field, an outer pressure container surrounding said inner container and spaced therefrom, heat insulating material contained in the space between said inner and outer containers for holding said pressure field and minimizing heat transfer between hot and cold regions of said engine, and a pressure backup region containing a pressurized gas medium constructed and arranged to transmit a uniform backup gas pressure to said working fluid.

18. The engine of claim 17 wherein;

said working fluid and said gas medium comprise different fluids.

19. The engine of claim 18 wherein;

said working fluid comprises helium and said gas medium comprises argon.

20. The engine of claim 17 wherein said pressure backup region is located in the upper portion of said inner container between the container wall and said liquid heat transfer medium.

21. The engine of claim 20 including;

means to selectively vary the gas pressure in said pressure backup region, and connector means comprising a conduit extending from said working fluid, through said liquid metal and into said pressure backup region.

22. The engine of claim 21 including;

a thin metal wall separating said liquid metal from said pressure backup region.

23. The engine of claim 17 wherein;

said pressure backup region is located in the space between the inner and outer containers, means to selectively vary the gas pressure in said pressure backup region, and restrictive port means in the wall of said inner container for maintaining said gas medium and said working fluid in fluid communication during operating cycles.

24. The engine of claim 23 wherein said restrictive port means is located in the cold section of the engine.

25. The engine of claim 23 including a plurality of restrictive port means in the wall of said inner container.

26. The engine of claim 23 wherein;

said working fluid and said gas medium comprise a common fluid substance.

27. The engine of claim 26 wherein;

said working fluid and said gas medium comprise helium.

28. The engine of claim 23 wherein;

said insulating material is located within said gas medium, said gas medium and said insulating material occupying the entire space between the inner and outer containers.

29. The engine of claim 28 wherein;

said insulating material comprises a ceramic fiber mat, said mat preventing significant convection current flow in the gas medium to reduce heat transfer through the pressure backup region.

30. The engine of claim 28 wherein;

said insulating material comprises a carbon fiber mat, said mat preventing significant convection current flow in the gas medium to reduce heat transfer through the pressure backup region.

31. The engine of claim 30 wherein;

said insulating material comprises a substantially solid material extending from the outer container and terminating a distance from the inner container wall to form an annular space defining said pressure backup region.

32. The engine of claim 31 wherein;

said insulating material comprises a solid rigid cast ceramic material.

33. The engine of claim 32 wherein;

said insulating material comprises a porous rigid cast ceramic material.

34. The dual shell engine of claim 33 including;

a thin metal wall on the inner surface of said insulating material spaced from said inner container, said metal wall and the inner container wall forming a narrow annulus defining said pressure backup region.

35. A method of providing a thermally insulated time varying pressure field which matches the working fluid pressure within the heat exchange conduit of a thermal engine comprising the steps of;

surrounding said conduit with a heat transfer liquid medium contained in a pressure transmitting inner shell, subjecting the liquid medium to the working fluid pressure within said engine, incorporating a thermal insulating medium contained in a rigid outer pressure shell to minimize heat transfer between said inner and outer shells, and forming a pressurized gas backup region containing a gaseous medium and transmitting a uniform backup gas pressure to said working fluid.

36. The method of claim 35 wherein;

said gas backup region is located between said inner and outer shells, said gas backup region being connected to said working fluid via a restricted port in the inner shell.

37. The method of claim 36 including the step of;

setting the size of said restricted port to obtain an oscillatory and minimal flow of gas therethrough to provide an average tensile and compressive load across said inner shell during engine operating cycles.

38. The method according to claim 35 wherein;

said gas backup region is located within said inner shell, said gas backup region being connected to said working fluid via conduit means extending from said working fluid, through said liquid medium and into said gas backup region.

39. The method of claim 38 including the step of;

setting the size of said conduit means to obtain an oscillatory and minimal flow of gas therethrough to provide an average tensile and compressive load across said inner shell during engine operating cycles.

40. The method of claim 35 including the step of applying the backup gas pressure at a desired level to minimize the absolute differential pressure load on said inner shell and said heat exchange conduit.

41. The method of claim 40 wherein the backup gas pressure is transmitted to the working fluid in the cold region of said engine.

42. The method of claim 41 including the step of;

transmitting the gas backup pressure to said working fluid via passage means which allows minimal flow of backup gas medium for averaging the system pressure during each cycle of engine operation.

43. The method of claim 42 wherein;

said gas backup pressure is transmitted via a plurality of passages to said working fluid.

44. A method of providing a thermally insulated time varying pressure field which matches the working fluid pressure within the heat exchange conduit of a thermal engine comprising the steps of surrounding said conduit with a heat transfer liquid medium contained in a pressure transmitting inner shell, subjecting the liquid medium to the working fluid pressure within said engine, incorporating a thermal insulating medium contained in a rigid outer pressure shell to minimize heat transfer between said inner and outer shells, forming a pressurized gas backup region containing a gaseous medium in fluid communication with said working fluid, and selectively pressurizing said gaseous medium to transmit a uniform backup gas pressure to said working fluid.

45. The method of claim 44 wherein;

said gas backup region is located between said inner and outer shells, said gas backup region being connected to said working fluid via a restricted port in the inner shell wall.

46. The method of claim 45 including the step of;

setting the size of said restricted port to obtain an oscillatory and minimal flow of gas therethrough to provide an average tensile and compressive load across said inner shell during engine operating cycles.

47. The method of claim 44 wherein;

said gas backup region is located within said inner shell, said gas backup region being connected to said working fluid via conduit means extending from said working fluid, through said liquid medium and into said gas backup region.

48. The method of claim 47 including the step of;

setting the size of said conduit means to obtain an oscillatory and minimal flow of gas therethrough to provide an average tensile and compressive load across said inner shell during engine operating cycles.

* * * * *

UNITED STATES PATENT AND TRADEMARK OFFICE

CERTIFICATE OF CORRECTION

PATENT NO. : 7,007,469 B2
APPLICATION NO. : 10/483784
DATED : March 7, 2006
INVENTOR(S) : Wayne T. Bliesner It is certified that error appears in the above-identified patent and that said Letters Patent is hereby corrected as shown below:

Claim 2, Col. 5, lines 66-67: Cancel, "and said working fluid in fluid communication during operating cycles."

Claim 10, Col. 6, line 39: Insert --and said working fluid in fluid communication during operating cycles.-- after "medium"

Signed and Sealed this

Fourth Day of July, 2006

JON W. DUDAS
*Director of the United States Patent and Trademark Office*